United States Patent [19]

Sonoda

[11] Patent Number: 4,949,693

[45] Date of Patent: Aug. 21, 1990

[54] FUEL INJECTION CONTROL DEVICE OF AN ENGINE

[75] Inventor: Yukihiro Sonoda, Susono, Japan

[73] Assignee: Toyota Jidosha Kabushiki Kaisha, Tokyo, Japan

[21] Appl. No.: 268,030

[22] Filed: Nov. 7, 1988

[30] Foreign Application Priority Data

Dec. 8, 1987 [JP] Japan ..... 62-310600

[51] Int. Cl.[5] ..... F02D 41/06; F02D 41/10; F02D 41/12

[52] U.S. Cl. ..... 123/491; 123/492; 123/493

[58] Field of Search ..... 123/491, 492, 493, 179 L

[56] References Cited

U.S. PATENT DOCUMENTS 4,442,812 4/1984 Mizuno et al. ..... 123/491

4,489,696 12/1984 Kobayashi et al. ..... 123/493

4,492,206 1/1985 Hasegawa et al. ..... 123/179 L 4,550,703 11/1985 Ootuka et al. ..... 123/478

FOREIGN PATENT DOCUMENTS 57-200632 12/1982 Japan .

*Primary Examiner*—Andrew M. Dolinar

[57] ABSTRACT

A fuel injection control device comprising an electronic control unit in which a changing rate of the amount of air fed into the engine cylinders per one revolution of the engine is calculated. The amount of fuel injected by the fuel injector is increased and decreased when the changing rate becomes positive and negative, respectively. The decrease in the amount of fuel injected by the fuel injector is prohibited even when the changing rate becomes negative until a predetermined time has elapsed after the engine is started.

15 Claims, 12 Drawing Sheets

FUEL INJECTION CONTROL DEVICE OF AN ENGINE

BACKGROUND OF THE INVENTION

1. Field of the Invention

The present invention relates to a fuel injection control device of an engine.

2. Description of the Related Art

In a known engine, the amount of air Q fed into the engine cylinders is detected by an air flow meter, and the engine speed Ne is detected by an engine speed sensor. The amount of air fed into the engine cylinders per one revolution of the engine Q/Ne (=QN) is calculated from the output signals of the air flow meter and engine speed, and the basic fuel injection time is calculated from QN. The actual fuel injection time is determined on the basis of the basic fuel injection time (see Japanese Unexamined Patent Publication No. 57-200632).

When the engine is started, the inner wall of the intake port is normally dry, and consequently, when fuel is first injected from the fuel injector, a large part of this fuel is used for wetting the inner wall of the intake port, and only a small part of the fuel is fed into the engine cylinders. Therefore, in the above-mentioned engine, to feed a sufficient amount of fuel into the engine cylinders, the basic fuel injection time is corrected so that the actual amount of fuel injected by the fuel injector is increased.

Further, when the engine is decelerated after the engine is started, since a high vacuum is produced in the intake port, a large proportion of the fuel adhering to the inner wall of the intake port is vaporized, and thus the air-fuel mixture fed into the engine cylinders becomes excessively rich. Note, the above-mentioned QN indicates an engine load, and thus QN becomes small when the engine is decelerated. Therefore, whether or not the engine is decelerated can be judged from a determination of whether or not QN is changed, i.e., QN is decreased. Consequently, in the above-mentioned engine, to prevent an excessively rich air-fuel mixture, the basic fuel injection time is corrected so that the actual amount of fuel injected by the fuel injector is reduced by an amount corresponding to a changing rate ΔQN of QN.

In this engine, if QN is changed only when the engine is decelerated, it is possible to continuously feed an air-fuel mixture having an optimum air-fuel ratio into the engine cylinders by reducing the actual amount of fuel injected by the fuel injector in accordance with a change in QN. But, in this engine, when the engine is started, since QN is reduced even though the engine is not decelerated, the actual amount of fuel injected by the fuel injector is reduced, i.e., upon engine start up, when the engine is rotated under its own power, the engine speed Ne is rapidly increased, but at this time, the amount of air Q fed into the engine cylinders remains substantially unchanged, and consequently, at this time, QN is rapidly reduced. As a result, since the actual amount of fuel injected by the fuel injector is reduced as soon as the engine is rotated under its own power, a problem occurs in that the engine stalls.

SUMMARY OF THE INVENTION

An object of the present invention is to provide a fuel injection control device by which a good engine start up can be obtained.

According to the present invention, there is provided a fuel injection control device of an engine having an engine cylinder and a fuel injector, the device comprising: an engine speed detecting means for detecting an engine speed; an air amount detecting means for detecting an amount of air fed into the engine cylinder; air amount calculating means for calculating the amount of air per one revolution of the engine on the basis of a result of a detection by the engine speed detecting means and the air amount detecting means; a fuel amount calculating means for calculating an amount of fuel injected by the fuel injector on the basis of a result of a calculation by the air amount calculating means; a changing rate calculating means for calculating a changing rate of the amount of air per one revolution of the engine on the basis of the result of the calculation by the air amount calculating means; a correction means for correcting the amount of fuel injected by the fuel injector in response to a change of the changing rate by increasing the amount of fuel when the changing rate is positive and to decreasing the amount of fuel when the changing rate is negative; and a prohibition means for prohibiting a decrease of the amount of fuel by the correction means, even when the changing rate is negative during a predetermined prohibition period after the engine is started.

The present invention may be more fully understood from the description of preferred embodiments of the invention set forth below, together with the accompanying drawings.

BRIEF DESCRIPTION OF THE DRAWINGS

In the drawings:

FIG. 12 is a diagram illustrating changes in the engine speed Ne and the transition state correction coefficient FAEW in the prior art.

DESCRIPTION OF THE PREFERRED EMBODIMENTS

Figure 1:
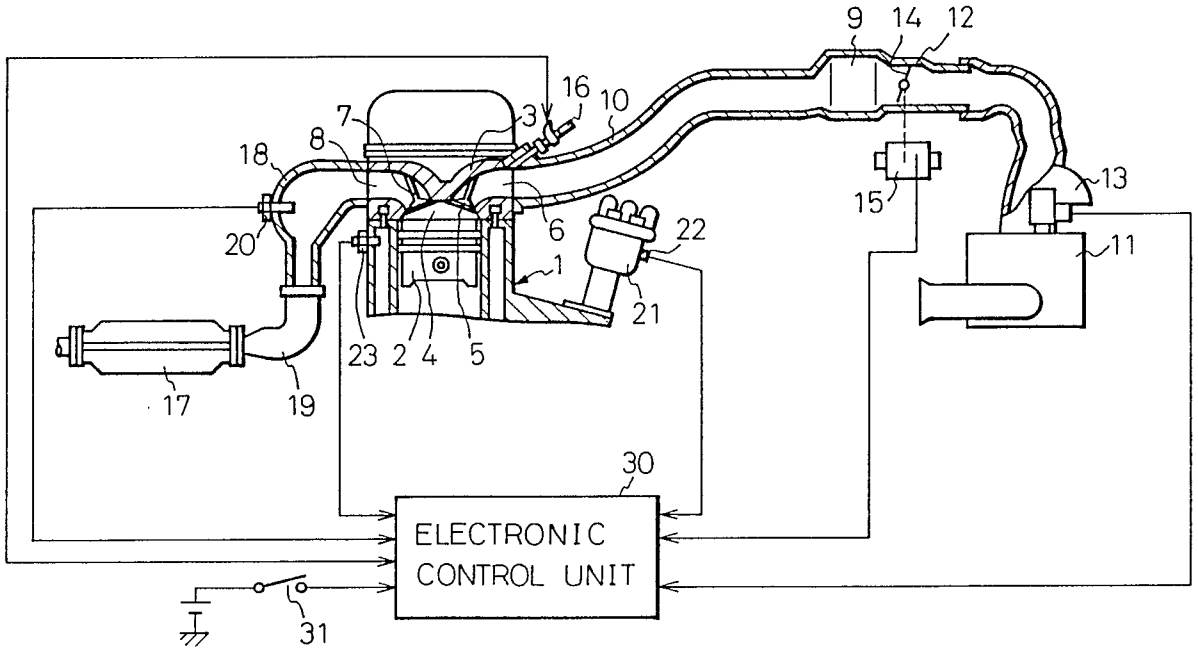
FIG. 1 is a schematically illustrated cross-sectional side view of an engine.

Referring to FIG. 1, reference numeral 1 designates an engine body, 2 a piston, 3 a cylinder head, 4 a combustion chamber, 5 an intake valve, 6 an intake port, 7 an exhaust valve, and 8 an exhaust port. A spark plug (not shown) is arranged in the combustion chamber 4. The intake port 6 is connected to a surge tank 9 via a branch pipe 10, and the surge tank 9 is connected to an air cleaner 11 via an intake duct 12 and an air flow meter 13. A throttle valve 14 is arranged in the intake duct 12 and connected to an idle switch 15. A fuel injector 16 is mounted on the branch pipe 10, and fuel is injected into the intake port 6 from the fuel injector 16. The exhaust port 8 is connected to a catalytic converter 17 containing a three way catalizer, via an exhaust manifold 18 and an exhaust pipe 19, and an oxygen concentration detector 20 (hereinafter referred to as an $O_2$ sensor) is arranged in the exhaust manifold 18. A distributor 21 is mounted on the engine body 1, and a crank angle sensor 22 is attached to the distributor 21. Also, a temperature sensor 23 is mounted on the engine body 1. The air flow meter 13, the idle switch 15, the fuel injector 16, the $O_2$ sensor 20, the crank angle sensor 22, and the temperature sensor 23 are connected to an electronic control unit 30. Electric power is supplied to the electronic control unit 30 via an ignition switch 31.

Figure 2:
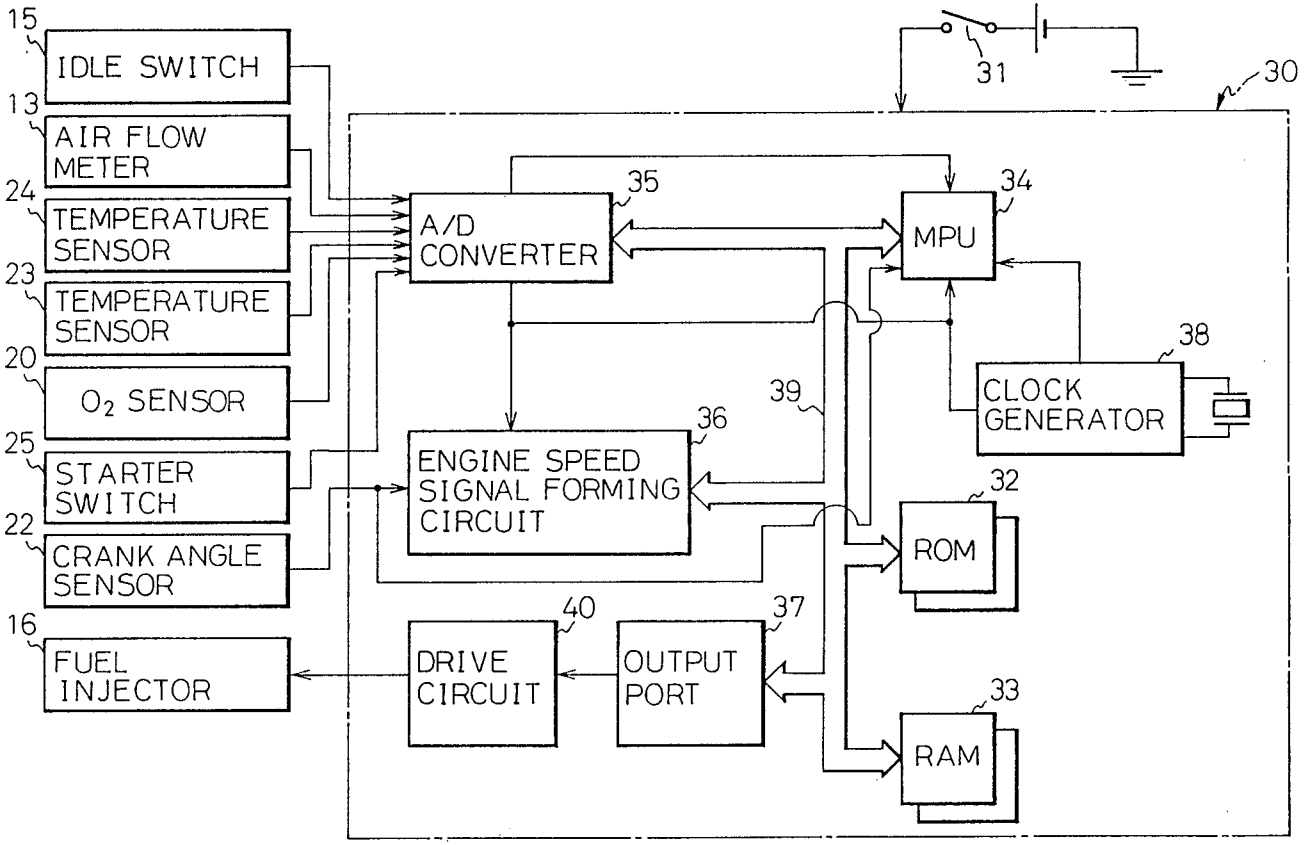
FIG. 2 is a block diagram of the electronic control unit.

Referring to FIG. 2, the electronic control unit 30 comprises a ROM (read only memory) 32, a RAM (random access memory) 33, an MPU (microprocessor, etc.) 34, an AD converter 35, an engine speed signal forming circuit 36, an output port 37, and a clock generator 38. The ROM 32, the RAM 33, the MPU 34, the AD converter 35, the engine speed signal forming circuit 36 and the output port 37 are interconnected via a bidirectional bus 39. The air flow meter 13, the idle switch 15, the $O_2$ sensor 20, and the temperature sensor 23 are connected to the AD converter 35. The air flow meter 13 produces an output voltage which is proportional to the amount of air Q fed into the engine cylinders. The idle switch 15 is made ON when the throttle valve 14 (FIG. 1) is in the idling position. The $O_2$ sensor 20 produces an output voltage of about 0.9 (V) when the air-fuel mixture fed into the engine cylinders becomes rich, and the $O_2$ sensor 20 produces an output voltage of about 0.1 (V) when the air-fuel mixture fed into the engine cylinders becomes lean. The temperature sensor 23 produces an output voltage which is proportional to the temperature of the cooling water of the engine. In addition, another temperature sensor 24 and a starter switch 25 are connected to the AD converter 35. This other temperature sensor 24 produces an output voltage which is proportional to the temperature of air fed into the engine cylinders, and the starter switch 25 is made ON when the starter motor (not shown) is operated. The output signals of the air flow meter 13, the idle switch 15, the $O_2$ sensor 20, the temperature sensors 23, 24, and the starter switch 25 are successively input to the MPU 34 via the AD converter 35.

The crank angle sensor 22 produces an output pulse at every 30° crank angle revolution of the engine, and the output pulses of the crank angle sensor 22 are input to the engine speed signal forming circuit 36. In the engine speed signal forming circuit 36, the engine speed Ne is calculated from the output pulses of the crank angle sensor 22, and data indicating the engine speed Ne is input to the MPU 34. The output port 39 is connected to the fuel injector 16 via a drive circuit 40.

In the embodiment illustrated in FIG. 1, the actual fuel injection time TAU is calculated from the following equation:

$$TAU = K.QN.FAF.(1 + FASE + FAEW).F(X)$$

where

K: constant

QN: the amount of air fed into the engine cylinders per one revolution of the engine FAF: feedback correction coefficient FASE: enrichment correction coefficient FAEW: transition state correction coefficient F(x): other correction coefficient QN represents (the amount of air Q fed into the engine cylinders)/(the engine speed Ne). As mentioned above, this QN indicates an engine load. Further, in the above equation, K.QN indicates the basic fuel injection time. The FAF is changed in accordance with the output signal of the $O_2$ sensor 20, so that the air-fuel ratio of the mixture fed into the engine cylinders approaches the stoichiometric air-fuel ratio.

The FASE is provided for increasing the amount of fuel injected by the fuel injector 16 when the engine is started. As mentioned above, when the engine is started, since the fuel initially injected by the fuel injector 16 is used for wetting the inner wall of the intake port 6, a sufficient amount of the fuel injected by the fuel injector 16 is not fed into the engine cylinders, and consequently, it is necessary to increase the amount of fuel injected by the fuel injector 16 when the engine is started.

The FAEW is provided for correcting the amount of the fuel injected by the fuel injector 16 in accordance with a change in the engine load, i.e., a change in QN. Namely, when the accelerator pedal (not shown) is depressed to accelerate the engine, since Q/Ne (=QN) is increased, the amount of fuel injected by the fuel injector 16 is increased. But, at this time, since the amount of fuel adhering to the inner wall of the intake port 6 is also increased, the amount of fuel fed into the engine cylinders temporarily becomes insufficient, and consequently, when QN is increased, FAEW is increased from zero to a predetermined positive value to increase the amount of fuel injected by the fuel injector 16. Conversely, when the accelerator pedal is released to decelerate the engine, since a larger amount of the fuel adhering to the inner wall of the intake port 6 is vaporized, the air-fuel mixture fed into the engine cylinders temporarily becomes excessively rich. Consequently, when the engine is decelerated, and thus QN is decreased, FAEW is reduced from zero to a predetermined negative value, to reduce the amount of fuel injected by the fuel injector 16.

F(X) is determined by, for example, the temperature of the cooling water of the engine and the temperature of air fed into the engine cylinders.

As mentioned above, by introducing the transition state correction coefficient FAEW into the equation used for calculating the actual fuel injection time TAU, it is possible to continuously feed an optimum air-fuel mixture into the engine cylinders even when the engine is in a transition state, i.e., even when the engine is accelerated or decelerated. Nevertheless, as mentioned above, at engine start up, when the engine is rotated under its own power, the engine speed Ne is rapidly increased but the amount of air Q fed into the engine remains substantially unchanged. Therefore, since QN is rapidly reduced, the transition state correction coefficient FAEW is also rapidly reduced from zero to a predetermined high negative value. As a result, since the actual amount of fuel injected by the fuel injector 16 is reduced as soon as the engine is rotated under its own power, a problem occurs in that the engine stalls. FIG. 12 illustrates the changes in Q/Ne (=QN), Ne, and FAEW, and as seen in FIG. 12, the FAEW is rapidly reduced as soon as the engine is rotated under its own power.

To solve the above-mentioned problem, in the present invention, the transition state correction coefficient FAEW is controlled so that a decrease in FAEW is prohibited even when QN is decreased a short time after the engine is started.

Figure 3:
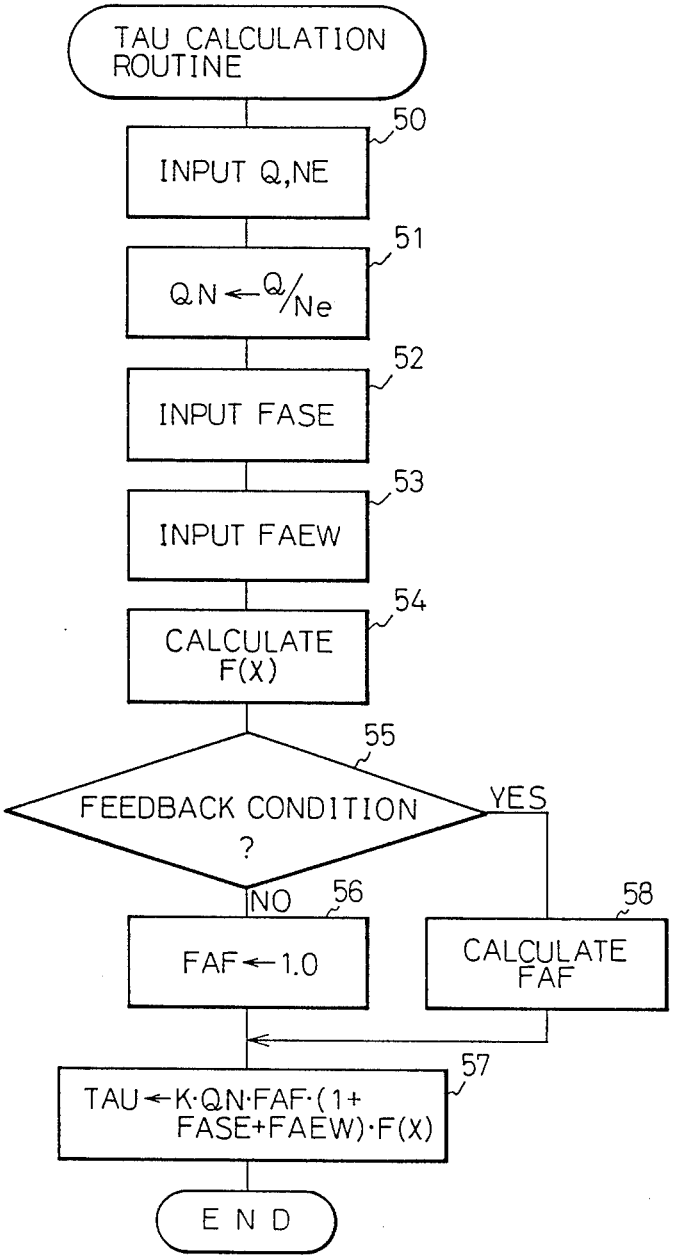
FIG. 3 is a flow chart for calculating the actual fuel injection time TAU.

FIG. 3 illustrates a routine for calculating the actual fuel injection time TAU. This routine is processed by sequential interruptions which are executed at predetermined crank angles.

Referring to FIG. 3, in step 50, data indicating the engine speed Ne and the amount of air Q fed into the engine cylinders is input to the MPU 34, and in step 51, QN is obtained by dividing Q by Ne. Then, in step 52, the enrichment correction coefficient FASE is input to the MPU 34, which FASE is calculated by a hereinafter described routine illustrated in FIG. 4, and in step 52, the transition state correction coefficient FAEW is input to the MPU 34, which FAEW is calculated by a hereinafter described routine illustrated by FIG. 6. Then, in step 54, the correction coefficient F(X) is calculated, and in step 55, it is determined whether or not the $O_2$ sensor 20 is producing a normal output signal. If the $O_2$ sensor 20 is not producing a normal output signal, the routine goes to step 56, and the feedback correction coefficient FAF becomes equal to 1.0. Since the temperature of the $O_2$ sensor 20 is low a short time after the engine is started, the 02 sensor 20 does not produce a normal output signal, and consequently, at this time the routine goes to step 56 from step 55, and FAF becomes equal to 1.0. The routine then goes to step 57, and the actual fuel injection time TAU is calculated from the following equation:

$$TAU=K.QN.FAF.(1+FASE+FAEW).F(X)$$

At this time, the feedback control of the air-fuel ratio is not carried out.

Conversely, if the $O_2$ sensor 20 is producing a normal output signal, the routine goes from step 55 to step 58, and FAF is changed on the basis of the output signal of the $O_2$ sensor 20, and the routine then goes to step 57. At this time, the feedback control of the air-fuel ratio is carried out so that the air-fuel ratio approaches the stoichiometric air-fuel ratio.

Figure 4:
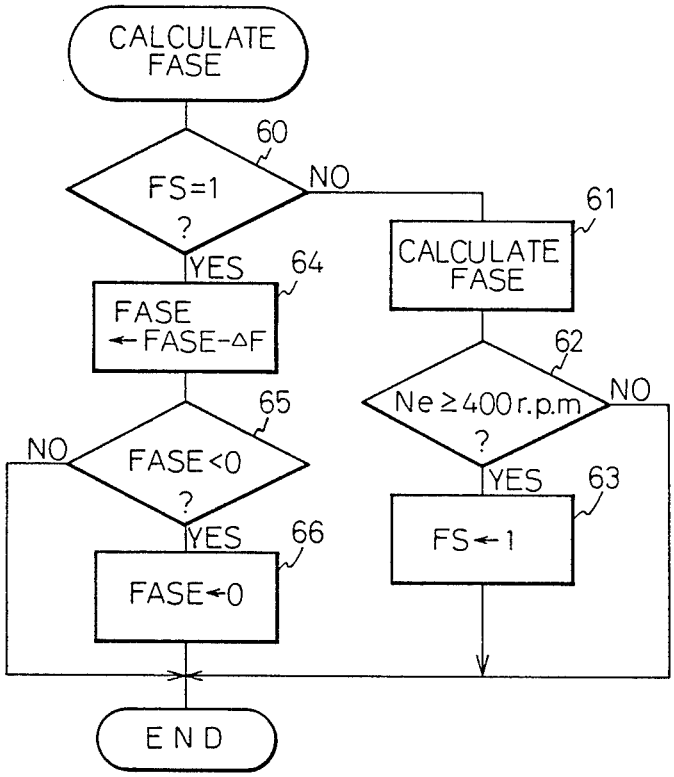
FIG. 4 is a flow chart for calculating the enrichment correction coefficient FASE.

FIG. 4 illustrates a routine for calculating the enrichment correction coefficient FASE. This routine is processed by sequential interruptions which are executed at predetermined intervals.

Figure 10A:
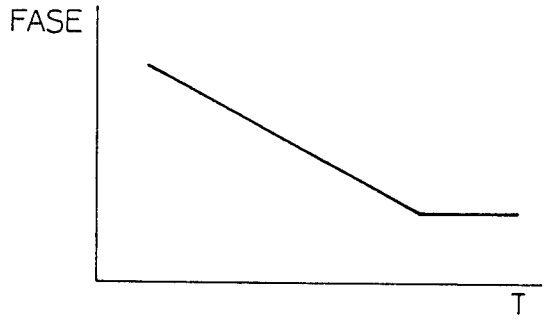
FIG. 10 is a diagram illustrating changes in the enrichment correction coefficient FASE and the transition state correction coefficient FAEW.

Referring to FIG. 4, in step 60, it is determined whether or not a flag FS is set. Since this flag FS is initially reset, the routine goes to step 61 from step 60, and FASE is calculated from the cooling water temperature T of the engine, on the basis of the relationship illustrated in FIG. 10A, and stored in the ROM 32. As can be seen from FIG. 10A, FASE becomes large as the cooling water temperature T becomes low.

Then, in step 62, it is determined whether or not the engine speed Ne exceeds 400 r.p.m. This 400 r.p.m. is an engine speed at which it is considered that the engine is rotated under its own power. If the engine speed Ne exceeds 400 r.p.m., the routine goes to step 63, and the flag FS is set. In the next processing cycle, the routine goes from step 63 to step 64, and a fixed value ΔF is subtracted from FASE, and in step 65, it is determined whether or not FASE has become smaller than zero. If FASE has become smaller than zero, the routine goes to step 66, and FASE is made equal to zero. Consequently, after the engine is rotated under its own power, FASE is gradually reduced, and once FASE reaches zero, it is maintained at zero thereafter.

Figure 5:
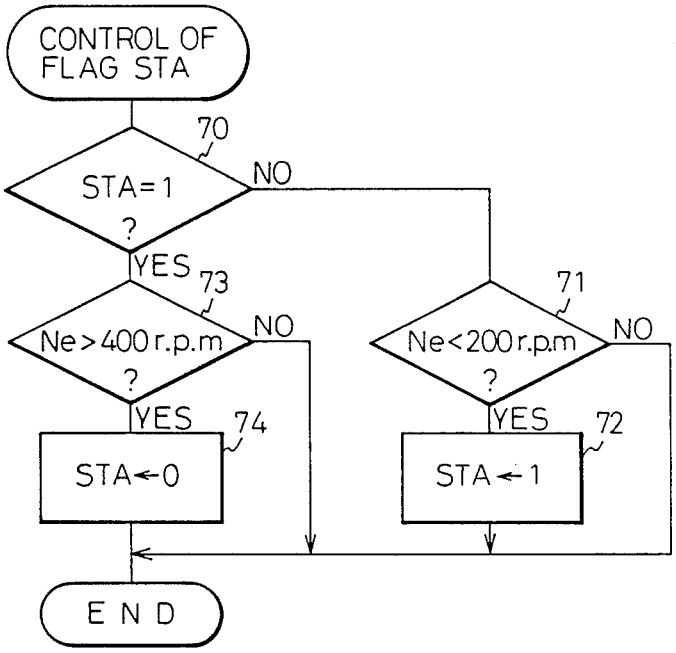
FIG. 5 is a flow chart for controlling the flag STA.

FIG. 5 illustrates a routine for controlling a flag STA indicating that the engine is rotated under its own power. This routine is processed by sequential interruptions which are executed at every 360° crank angle. Thus, this routine is executed when the engine is first cranked, and the crank angle then becomes equal to the interruption crank angle. If the routine is executed, in step 70, it is determined whether or not the flag STA is set. Since the flag STA is initially reset, the routine goes to step 71, and it is determined whether or not the engine speed Ne is lower than a predetermined speed, for example, 200 r.p.m. At this time, since the engine is being cranked, the routine goes to step 72, and the flag STA is set.

In the next processing cycle, the routine goes to step 73 from step 70, and it is determined whether or not the engine speed Ne is higher than 400 r.p.m. If the engine speed Ne exceeds 400 r.p.m., the routine goes to step 74, and the flag STA is reset; i.e., the flag STA is reset when the engine is rotated under its own power after the engine is first cranked. Consequently, it is determined from the state of the flag STA whether or not the engine is rotated under its own power.

Figure 6:
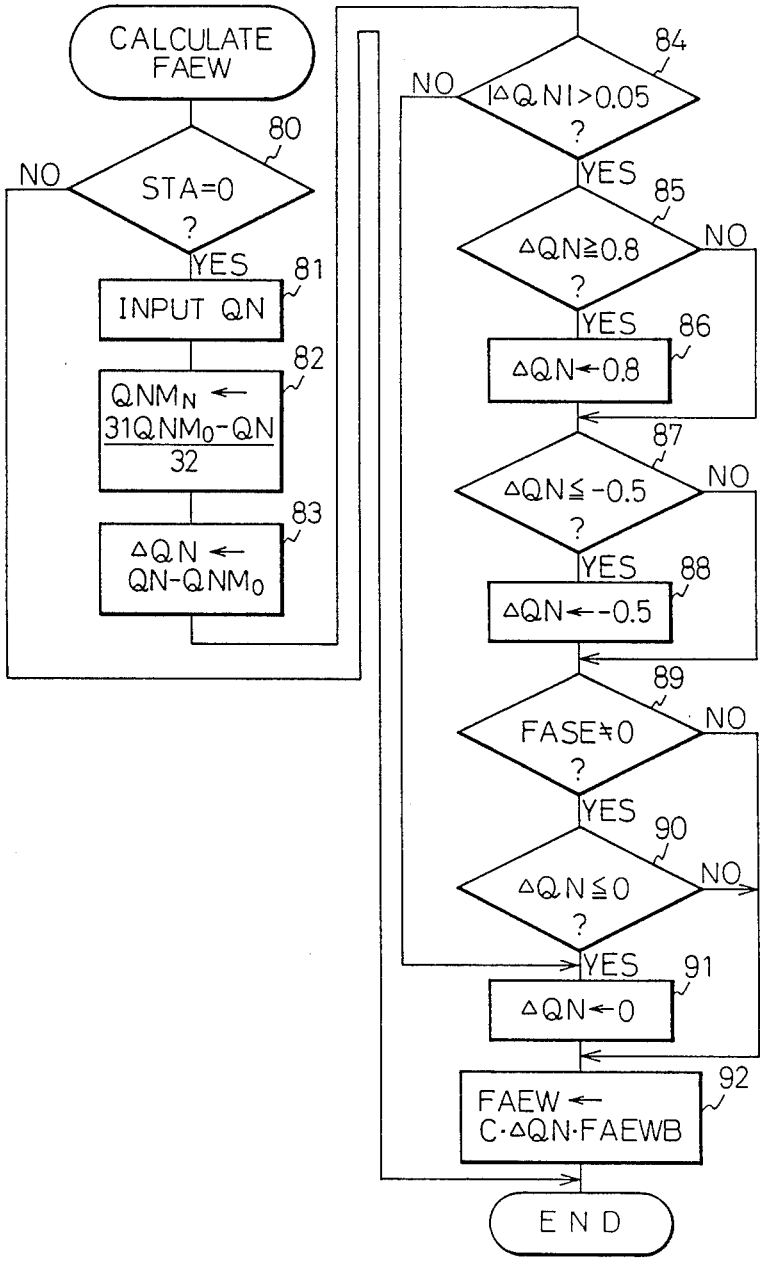
FIG. 6 is a first embodiment of the flow chart for calculating the transition state correction coefficient FAEW.

FIG. 6 illustrates a first embodiment of a routine for calculating the transition state correction coefficient FAEW. This routine is processed by sequential interruptions which are executed at every 360° crank angle.

Referring to FIG. 6, in step 80 it is determined whether or not the flag STA is reset, i.e., the engine is rotated under its own power. If the engine is rotated under its own power, the routine goes to step 81, and QN calculated in step 51 of FIG. 3 is input to the MPU 34. Then, in step 82, the present weighted mean value QNMn of the amount of air fed into the engine cylinders per one revolution of the engine QN is calculated from the following equation.

$$QNMn=(31QNM0+QN)/32$$

Where, QNN0 is the weighted mean value of QN which has been calculated in the preceding processing cycle.

Then, in step 83, the changing rate ΔQN of QN is calculated by subtracting the weighted mean value $QNM_0$ in the preceding processing cycle from the present amount of air per one revolution of the engine QN, and the routine then goes to step 84. In step 84, to prevent a change in the amount of fuel injected by the fuel injector 16, in response to a slight change of ΔQN, it is determined whether or not the absolute value of the changing rate ΔQN of QN exceeds a small value of, for example, 0.05 l/rev. If the absolute value of the changing rate ΔQN is smaller than 0.05, the routine jumps to step 91, and ΔQN is made equal to zero. Consequently, at this time, in the next step 92, since FAEW is made equal to zero, the actual fuel injection time TAU is not changed. If the absolute value of the changing rate ΔQN of QN exceeds 0.05, in steps 85 through 88, the guard is applied to the changing rate ΔQN of QN so that ΔQN does not exceed the upper limit and the lower limit. Namely, when the changing rate ΔQN of QN exceeds the upper limit, for example, 0.8, the changing rate ΔQN of QN is restricted and can not exceed the upper limit, in step 86, and when the changing rate ΔQN of QN falls below the lower limit, for example, −0.5, the changing rate ΔQN of QN is restricted and can not fall below the lower limit in step 88, and the routine then goes to step 89.

Figure 11:
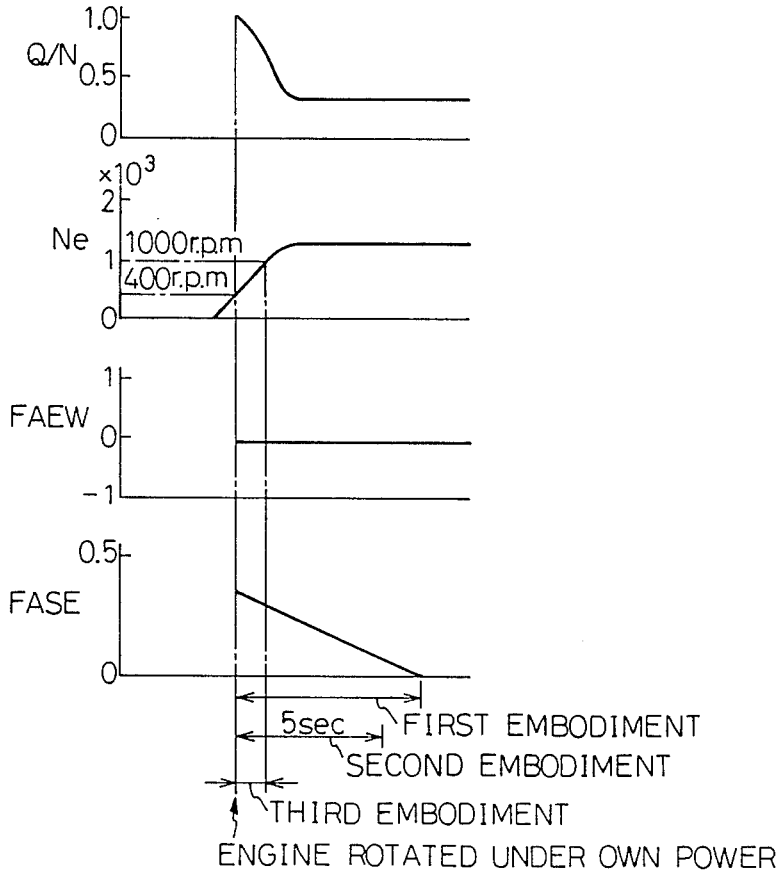
FIG. 11 is a diagram illustrating changes in the engine speed Ne and the transition state correction coefficient FAEW in the present invention.

In step 89, it is determined whether or not the enrichment correction coefficient FASE is equal to zero. As illustrated in FIG. 11, this FASE is gradually reduced after the engine is rotated under its own power, and the enrichment operation is carried out during the time this FASE has a positive value. If FASE is made equal to zero, that is, if the enrichment operation is completed, the routine jumps to step 92, and the transition state correction coefficient FAEW is calculated from the following equation:

$$FAEW = C.\Delta QN.FAEWB$$

Figure 10B:
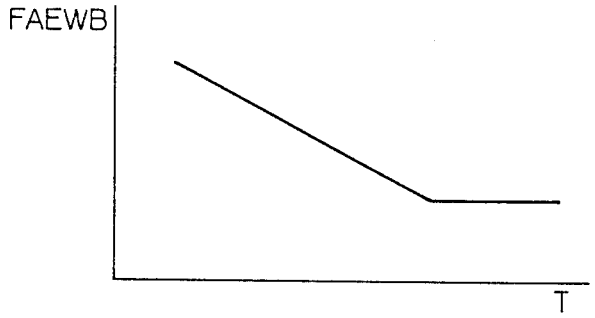

In the above equation, C is constant, and FAEWB is the basic transition state correction coefficient. This FAEWB is calculated from the cooling water temperature T of the engine on the basis of the relationship illustrated in FIG. 10B, and stored in the ROM 32. As can be seen from FIG. 10B, FAEWB becomes larger as the cooling water temperature T becomes lower. At this time, FAEW is changed in accordance with a degree of the changing rate ΔQN of QN. Namely, when the engine is accelerated and the ΔQN becomes a positive value, the actual fuel injection time TAU is increased, and when the engine is decelerated and the ΔQN becomes a negative value, the actual fuel injection time TAU is reduced. Consequently, it is possible to feed an optimum air-fuel mixture into the engine cylinders even in a transition state of the engine.

When it is determined in step 89 that FASE is not equal to zero, i.e., when the enrichment operation is carried out, the routine goes to step 90, and it is determined whether or not the changing rate ΔQN of QN is less than zero. If the changing rate ΔQN of QN is less than zero, the routine goes to step 91, and thus the ΔQN is made equal to zero. As a result, in step 92, FAEW is made equal to zero, i.e., even when ΔQN becomes a negative value, a decrease in FAEW is prohibited, and as a result, it is possible to prevent the engine stalling immediately after the engine is rotated under its own power.

When it is determined in step 90 that the changing rate ΔQN of QN is larger than zero, the routine jumps to step 92. Consequently, in this case, FAEW is increased in accordance with the changing rate ΔQN of QN. Namely, when the engine is accelerated while the enrichment operation is carried out, the actual fuel injection time TAU is increased.

Figure 7:
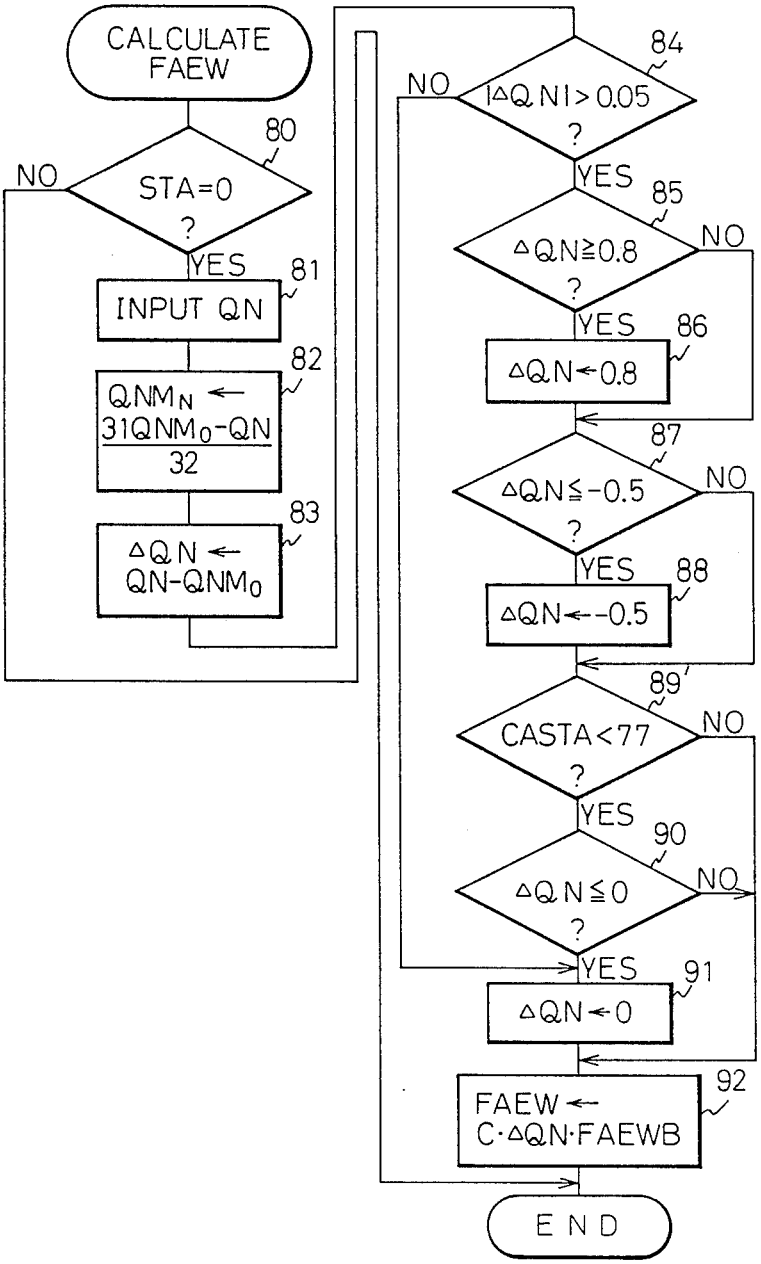
FIG. 7 is a second embodiment of the flow chart for calculating the transition state correction coefficient FAEW.
Figure 8:
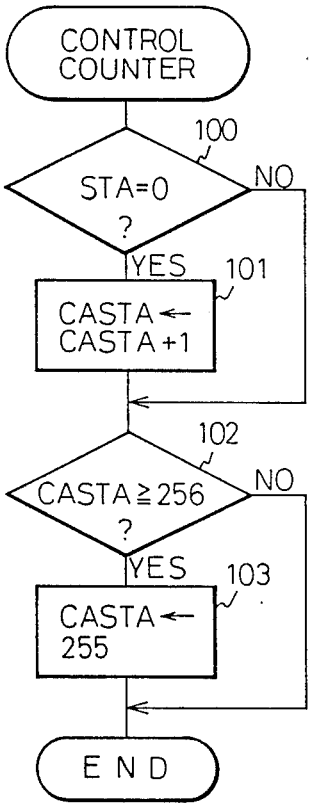
FIG. 8 is a flow chart for controlling the counter.

FIG. 7 illustrates a second embodiment of the routine for calculating the transition state correction coefficient FAEW. This routine is also processed by sequential interruptions which are executed at every 360° crank angle. In this embodiment, a decrease in FAEW is prohibited even when the changing rate ΔQN of QN becomes a negative value during a predetermined time, for example, about 5 sec after the engine is rotated under its own power. In this embodiment, to calculate a time elapsed after the engine is rotated under its own power, the routine for controlling a counter, illustrated in FIG. 8, is used. This routine is processed by sequential interruptions which are executed at predetermined intervals of, for example, 65 msecs.

Referring to FIG. 8, in step 100, it is determined whether or not the flag STA is reset, i.e., the engine is rotated under its own power. If the engine is rotated under its own power, the routine goes to step 101, and the count value CASTA is incremented by one. Then, in steps 102 and 103, to prevent an overflow of the count value CASTA, the count value CASTA is restricted so that it can not exceed a maximum value of, for example, 256.

Turning to FIG. 7, steps 80 through 88 and steps 90 through 92 are the same as steps 80 through 88 and steps 90 through 92 in FIG. 6, and only step 89, in FIG. 7 is different from step 89 in FIG. 6. Consequently, a description of steps 80 through 88 and steps 90 through 92 is omitted.

In this embodiment illustrated in FIG. 7, in step 89', it is determined whether or not the count value CASTA is smaller than a predetermined value, for example, 77, which corresponds to about 5 secs. If the count value CASTA is smaller than 77, i.e., when 5 sec has not elapsed after the engine is rotated under its own power, the routine goes to step 90. When it is determined in step 90 that the changing rate ΔQN of QN is less than zero, ΔQN is made equal to zero in step 91. Consequently, in this embodiment, a decrease in FAEW is prohibited even when the changing rate ΔQN of QN becomes a negative value during a period of about 5 sec after the engine is rotated under its own power.

Figure 9:
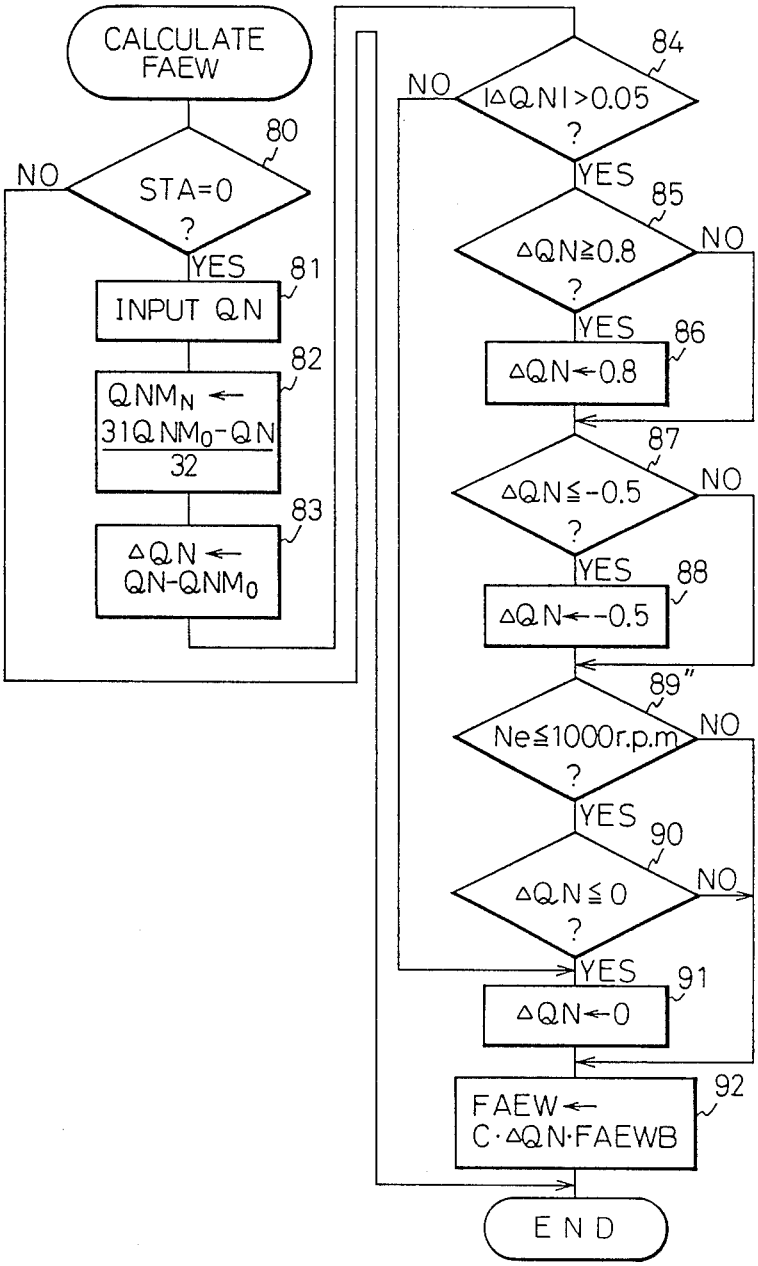
FIG. 9 is a third embodiment of the flow chart for calculating the transition state correction coefficient FAEW.

FIG. 9 illustrates a third embodiment of the routine for calculating the transition state correction coefficient FAEW. This routine is also processed by sequential interruptions which are executed at every 360° crank angle. In this embodiment, a decrease in FAEW is prohibited even when the changing rate ΔQN of QN becomes a negative value when the engine speed Ne does not exceed a predetermined speed, for example, 1000 r.p.m. In FIG. 9, steps 80 through 88 and steps 90 through 92 are the same as steps 80 through 88 and steps 90 through 92 in FIG. 6, and only step 89'' in FIG. 9, is different from step 89 in FIG. 6. Consequently, a description of steps 80 through 88 and steps 90 through 92 is omitted.

In this embodiment illustrated in FIG. 9, in step 89'', it is determined whether or not the engine speed Ne is lower than a predetermined speed, for example, 1000 r.p.m. If the engine speed Ne is lower than 1000 r.p.m., the routine goes to step 90. When it is determined in step 90 that the changing rate ΔQN of QN is less than zero, ΔQN is made equal to zero in step 91. Consequently, in this embodiment, a decrease in FAEW is prohibited even when the changing rate ΔQN of QN becomes a negative value when the engine speed Ne is lower than 1000 r.p.m.

FIG. 11 illustrates the times during which the decrease in FAEW is prohibited in the above-mentioned three embodiments. As mentioned above, in the first embodiment, the decrease in FAEW is prohibited until the enrichment correction coefficient FASE is made zero after the engine is rotated under its own power. In the second embodiment, the decrease in FAEW is prohibited until about 5 sec has elapsed after the engine is rotated under its own power. In the third embodiment, the decrease in FAEW is prohibited until the engine speed Ne has exceeded 1000 r.p.m. after the engine is rotated under its own power. As can be seen from FIG. 11, the time during which the decrease in FAEW is prohibited in the third embodiments is shorter than that in the first and the second embodiments. But, in the third embodiment, when the prohibition of the decrease in FAEW is released, the engine speed Ne is 1000 r.p.m. and thus sufficiently increased, and at this time, the amount of air per one revolution of the engine QN is very stable. Consequently, even if the prohibition of the decrease in FAEW is released at a relatively earlier time, there is no danger that the engine will stall.

Also in the second and the third embodiments, the increase in the actual fuel injection time TAU based on the enrichment correction coefficient FASE in carried out. But, in the second and the third embodiments, it is not always necessary to carry out the increase in the actual fuel injection time TAU based on FASE. In addition, it is possible to carry out the prohibition of the decrease in FAEW by selectively combining the first, the second, and the third embodiments. Namely, the decrease in FAEW may be prohibited when the enrichment operation based on FASE is carried out and until a fixed time has elapsed after the engine is rotated under its own power. Further, the decrease in FAEW may be prohibited when the engine speed is lower than a predetermined speed and until a fixed time has elapsed after the engine is rotated under its own power. Furthermore, the decrease in FAEW may be prohibited when the enrichment operation based on FASE is carried out and when the engine speed is lower than a predetermined speed.

While the invention has been described by reference to specific embodiments chosen for purposes of illustration, it should be apparent that numerous modifications could be made thereto by those skilled in the art without departing from the basic concept and scope of the invention.

I claim:

1. A fuel injection control device of an engine having an engine cylinder and a fuel injector, said device comprising:

engine speed detecting means for detecting an engine speed;

air amount detecting means for detecting an amount of air fed into the engine cylinder;

air amount calculating means for calculating said amount of air per one revolution of the engine on the basis of a result of a detection by said engine speed detecting means and said air amount detecting means;

fuel amount calculating means for calculating an amount of fuel injected by the fuel injector on the basis of a result of a calculation by said air amount calculating means;

changing rate calculating means for calculating a changing rate of said amount of air per one revolution of the engine on the basis of the result of the calculation by said air amount calculating means;

correction means for correcting said amount of fuel injected by the fuel injector in response to a change of said changing rate to increase said amount of fuel when said changing rate is positive and to decrease said amount of fuel when said changing rate is negative;

enrichment means for increasing said amount of fuel during a predetermined enrichment period after the engine is started; and prohibition means for prohibiting a decreasing operation of said amount of fuel, which operation is effected by said correction means, even when said changing rate is negative during a predetermined prohibition period after the engine is started, wherein said predetermined prohibition period is equal to said predetermined enrichment period.

2. A fuel injection control device according to claim 1, wherein said enrichment means controls an enrichment correction coefficient which corrects said amount of fuel, said amount of fuel being increased as said enrichment correction coefficient is increased, said enrichment correction coefficient being reduced from a predetermined value to zero during said predetermined enrichment period.

3. A fuel injection control device according to claim 2, wherein said predetermined value becomes large as an engine temperature becomes low.

4. A fuel injection control device according to claim 1, wherein a correction of said amount of fuel, which is effected by said correction means, is not carried out when an absolute value of said amount of air per one revolution of the engine is smaller than a predetermined value.

5. A fuel injection control device according to claim 1, wherein said correction means controls a transition state correction coefficient which corrects said amount of fuel, said amount of fuel being increased and decreased as said transition state correction coefficient is increased and decreased, respectively, said transition state correction coefficient being obtained by multiplying said changing rate by a predetermined basic transition state correction coefficient.

6. A fuel injection control device according to claim 5, wherein said basic transition state correction coefficient becomes large as an engine temperature becomes low.

7. A fuel injection control device according to claim 1, wherein it is determined that the engine start up is completed when the engine is rotating under its own power.

8. A fuel injection control device according to claim 7, wherein it is determined that the engine is rotating under its own power when the engine speed exceeds about 400 r.p.m.

9. A fuel injection control device of an engine having an engine cylinder and a fuel injector, said device comprising:

engine speed detecting means for detecting an engine speed;

air amount detecting means for detecting an amount of air fed into the engine cylinder;

air amount calculating means for calculating said amount of air per one revolution of the engine on the basis of a result of a detection by said engine speed detecting means and said air amount detecting means;

fuel amount calculating means for calculating an amount of fuel injected by the fuel injector on the basis of a result of a calculation by said air amount calculating means;

changing rate calculating means for calculating a changing rate of said amount of air per one revolution of the engine on the basis of the result of the calculation by said air amount calculating means;

correction means for correcting said amount of fuel injected by the fuel injector in response to a change of said changing rate to increase said amount of fuel when said changing rate is positive and to decrease said amount of fuel when said changing rate is negative; and prohibition means for prohibiting a decreasing operation of said amount of fuel, which operation is effected by said correction means, even when said changing rate is negative during a predetermined prohibition period after the engine is started, wherein said predetermined prohibition period is a period until the engine speed exceeds a predetermined speed after the engine is started.

10. A fuel injection control device according to claim 9, wherein said predetermined speed is about 1000 r.p.m.

11. A fuel injection control device according to claim 9, wherein a correction of said amount of fuel, which is effected by said correction means, is not carried out when an absolute value of said amount of air per one revolution of the engine is smaller than a predetermined value.

12. A fuel injection control device according to claim 9, wherein said correction means controls a transition state correction coefficient which corrects said amount of fuel, said amount of fuel being increased and decreased as said transition state correction coefficient is increased and decreased, respectively, said transition state correction coefficient being obtained by multiplying said changing rate by a predetermined basic transition state correction coefficient.

13. A fuel injection control device according to claim 9, wherein said basic transition state correction coefficient becomes large as an engine temperature becomes low.

14. A fuel injection control device according to claim 9, wherein it is determined that the engine start up is completed when the engine is rotating under its own power.

15. A fuel injection control device according to claim 14, wherein it is determined that the engine is rotating under its own power when the engine speed exceeds about 400 r.p.m.

* * * * *

UNITED STATES PATENT AND TRADEMARK OFFICE

CERTIFICATE OF CORRECTION

PATENT NO. : 4,949,693

DATED : August 21, 1990

INVENTOR(S) : Yukihiro SONODA

It is certified that error appears in the above-identified patent and that said Letters Patent is hereby corrected as shown below:

Column 4, line 6, and Column 5, line 44, change "TAU=K.QN.FAF.(1+FASE+FAEW).F(X)" to --TAU=K·QN·FAF·(1+FASE+FAEW)·F(X)--.

Column 4, line 19, change "K.QN" to --K·QN--.

Column 6, line 51, change "QNMn=(31QNMO+QN)/32" to --QNMn=(31QNM$_0$+QN)/32--.

Column 6, line 53, change "QNNO" to-QNN$_0$--.

Column 7, line 24, change "FAEW=C.ΔQN.FAEWB" to --FAEW=C·ΔQN·FAEWB--.

Column 8, line 18, change "89," to =-89'--.

Signed and Sealed this

Twenty-fifth Day of February, 1992

*Attest:*

HARRY F. MANBECK, JR.

*Attesting Officer*

*Commissioner of Patents and Trademarks*